US007850089B2

(12) United States Patent
Freudenstein et al.

(10) Patent No.: US 7,850,089 B2
(45) Date of Patent: Dec. 14, 2010

(54) FIXED CARRIAGEWAY FOR RAIL VEHICLES AND METHOD OF MANUFACTURING THE SAME

(75) Inventors: Stephan Freudenstein, Neumarkt (DE); Franz Geissler, Velburg (DE); Christof Nottbeck, Neumarkt (DE); Sascha Lay, Neumarkt (DE)

(73) Assignee: Rail.One GmbH, Neumarkt (DE)

( * ) Notice: Subject to any disclaimer, the term of this patent is extended or adjusted under 35 U.S.C. 154(b) by 636 days.

(21) Appl. No.: 10/588,827

(22) PCT Filed: Feb. 15, 2006

(86) PCT No.: PCT/DE2006/000284

§ 371 (c)(1),
(2), (4) Date: Oct. 12, 2006

(87) PCT Pub. No.: WO2006/111113

PCT Pub. Date: Oct. 26, 2006

(65) Prior Publication Data

US 2007/0164125 A1 Jul. 19, 2007

(30) Foreign Application Priority Data

Apr. 19, 2005 (DE) ..... 10 2005 018 195

(51) Int. Cl.
*E01B 1/00* (2006.01)

(52) U.S. Cl. ..... 238/7; 238/2

(58) Field of Classification Search ..... 238/2, 238/3, 4, 5, 6, 7, 8, 9, 265, 85, 86, 115, 116, 238/117, 109; 52/664, 678, 684, 685, 686; D8/395, 396

See application file for complete search history.

(56) References Cited

U.S. PATENT DOCUMENTS

| | | | | |
|---|---|---|---|---|
| 4,617,775 | A * | 10/1986 | Padrun | 52/684 |
| 5,371,991 | A * | 12/1994 | Bechtel et al. | 52/686 |
| 6,237,856 | B1 | 5/2001 | Bachmann et al. | |

FOREIGN PATENT DOCUMENTS

| | | | |
|---|---|---|---|
| DE | 198 49 266 | * | 5/2000 |
| DE | 198 48 928 | | 10/2000 |
| DE | 199 59 978 | | 4/2001 |
| EP | 0 715 021 | | 6/1996 |
| EP | 0 777 015 | | 6/1997 |
| EP | 0 980 931 | | 2/2000 |
| JP | 4-97064 | * | 3/1992 |

* cited by examiner

*Primary Examiner*—Mark T Le
(74) *Attorney, Agent, or Firm*—Jordan and Hamburg LLP

(57) ABSTRACT

Fixed carriageway for rail vehicles having sleepers embedded in a carriageway panel and a reinforcement includes plural longitudinal and transverse rods disposed parallel and transverse to the sleepers, wherein the longitudinal rods and transverse rods are electrically isolated from one another.

14 Claims, 6 Drawing Sheets

FIXED CARRIAGEWAY FOR RAIL VEHICLES AND METHOD OF MANUFACTURING THE SAME

BACKGROUND OF THE INVENTION

The invention relates to a fixed carriageway for rail vehicles having sleepers embedded in a carriageway panel and a reinforcement, which comprises plural longitudinal rods and transverse rods disposed in the carriageway panel parallel and transverse to the sleepers.

The term "fixed carriageway" refers to a section of rail with a superstructure, in which the ballast is replaced by another material such as concrete or asphalt for example. In the construction of the fixed carriageway, the sleepers are adjusted and embedded in a casting compound, creating a carriageway panel. The substructure of the carriageway panel may comprise a hydraulically bonded support layer, a ballast support layer, a frost-protection layer, a foil or a geotextile.

In the operation of rail sections, it is necessary to determine whether a certain section of track is clear or whether a train is located thereon. To this end, track circuits can be used in which a transmitter feeds an audio frequency signal into the track in such a manner that the rails act as to-and-fro conductors. At a remote site, the signal is evaluated by a receiver and by means of the signal level received, it is decided whether the section of track between the transmitter and receiver is clear.

One of these track circuit systems, which is available under the reference UM71 and is used in various countries, operates with four carrier frequencies of between 1.7 and 3.1 kHz.

Due to the impedances of rails and track connectors, the signal levels of the track circuits are damped or energy is drained from the track circuits as the distance between transmitter and receiver increases. Since the system is impressed particularly by inductive voltage drops due to the frequencies used, this component of damping can be compensated by the regular arrangement of specified transverse capacitances between the two rails. On a clear section, with compensation, maximum track circuit lengths of 1500 meters can be achieved. In non-compensated realisations, on the other hand, only track circuit lengths of 450 meters maximum are possible. Conventional track circuit systems, such as the above-mentioned system UM71, have hitherto been used predominantly with ballast carriageways.

A reason for not using such track circuits in fixed carriageways, however, is the fact that in these carriageways transverse rods and longitudinal rods are present in the concrete support panel as reinforcement. In the reinforcing rods extending longitudinally to the track axis, due to the magnetic fields of the audio frequency rail currents, a voltage is induced. Closed short-circuit current paths can form via the transverse reinforcements. The losses thus occurring in the reinforcement rods cause additional damping of the track circuit signals or to additional energy depletion. A possible consequence of this is that the receiver of the track circuit no longer measures a sufficient level in spite of a clear section of track and thus signals that the track is occupied, which is not in fact the case.

SUMMARY OF THE INVENTION

An object of the invention is therefore to indicate a fixed carriageway in which a track circuit system can be used in a trouble-free manner.

To achieve this, in a fixed carriageway of the type mentioned in the introduction, it is provided that the longitudinal rods and the transverse rods are electrically isolated from one another.

By means of electrical isolation, the formation of closed short-circuit current paths is prevented, and accordingly damping of the track circuit signals does not occur. The receiver of the track circuit then only measures a low level if a train is in fact on the section of track.

In a further embodiment of the invention, it can be provided that longitudinal rods extending parallel to one another and/or coupled together are isolated from one another in the overlap region. Electrical interruption of the longitudinal rods is a particularly effective way of reducing damping. The length of the continuous longitudinal rods of the reinforcement is thus shortened to a specified value, so that the desired reduced damping is set.

Trouble-free operation of the track circuit can be achieved in the fixed carriageway according to the invention in that a spacer is disposed between two rods to be isolated from one another. A spacer of this type can be assembled with virtually no cost or complication in the construction of the fixed carriageway. By means of the spacer, the rods to be isolated from one another are held at a specified distance from one another before being embedded in the casting compound, so that no electrical connection forms between the longitudinal rods and the transverse rods. In this case, it may be considered a particularly great advantage that the static properties of the fixed carriageway are not affected by the spacers, since in the carriageway according to the invention, the same longitudinal and transverse rods are used as before, lying virtually in the same place as in conventional fixed carriageways.

It is also within the scope of the invention that the spacer comprises a first section at least partially engaging round the first rod and a second section at least partially engaging around the second rod. A spacer so constructed is characterised by particularly good grip on the rods, so that slipping off or displacement is virtually impossible. An even better grip and particularly safe fixing are achieved if the first and second section of a spacer are formed in the shape of segments of a circle and are adapted to the outer diameter of the rods. In the case of spacers which are used at points of intersection of a longitudinal rod with a transverse rod, the first and second section of the spacer can be offset with respect to one another by 90°.

Spacers can be particularly easily mounted on the fixed carriageway if the two sections are formed as clips. In this case, it can be provided that the spacers consist of a resilient material, in particular a plastics material. Such spacers can be manufactured economically and can be clipped easily on to the normally round rods.

It is within the scope of the invention that longitudinal rods are isolated by spacers from transverse rods which are formed for example as lower booms of a grid support of a sleeper. Sleepers for a fixed carriageway may for example have two sleeper blocks, which are connected together by two grid supports extending in parallel. The grid support(s) conventionally comprises or comprise plural grid rods extending transversely and acting as transverse rods. By means of the isolation provided according to the invention of the longitudinal rods from the transverse rods by spacers, problem-free functioning of the track circuit system is ensured.

In a further embodiment of the invention, it can be provided that in a sleeper having two grid supports of the fixed carriageway according to the invention, spacers are only mounted on one lower boom of a grid support. Thus the other lower booms of the grid support are automatically kept at a distance from the longitudinal rods, so that the desired electrical isolation is achieved.

According to an alternative, also particularly effective modification of the fixed carriageway according to the invention, in the case of rods to be isolated from one another, at least one rod may have an insulating coating. The coating serves the same purpose as the spacer, as it prevents contact between a transverse rod and a longitudinal rod, so that short-circuit current paths do not form. Accordingly, an additional energy drain or damping of the track circuit signals is also prevented.

Advantageously, a transverse rod having the insulating coating may be formed as the lower boom of a grid support of a sleeper. A lower boom of this type can be provided with the insulating coating all over, so that at no point can there be unwanted contact with a longitudinal rod.

In order to minimise the construction cost, it is sufficient in the fixed carriageway according to the invention that in the case of a sleeper having plural grid supports, only one lower boom of a grid support has the insulating coating. It is particularly advantageous that the lower boom having the insulating coating has a different height position, in particular a lower height, than the other lower booms. The longitudinal rods can then rest on the shallower lower boom without contact being formed between them, and in addition the longitudinal rods are also isolated from the same lower booms, which have a normal height.

It can be provided that in the fixed carriageway according to the invention, additionally the sections of the grid support adjoining the lower boom may have an insulating coating. Thus also, contact between the longitudinal rods and/or vertically extending sections of the grid support of the sleeper is prevented.

In addition, the invention relates to a method of manufacturing a fixed carriageway for rail vehicles with sleepers embedded in a carriageway panel and reinforcement, which comprises plural longitudinal rods and transverse rods disposed in the carriageway panel parallel and transversely to the sleepers.

In the method according to the invention it is provided that the longitudinal rods and the transverse rods are installed electrically isolated from one another.

Further embodiments of the invention are indicated in the subclaims.

Further advantages and details of the invention are explained by means of embodiments with reference to the Figures, which are diagrammatic representations.

DESCRIPTION OF THE PREFERRED EMBODIMENTS

Figure 1A:
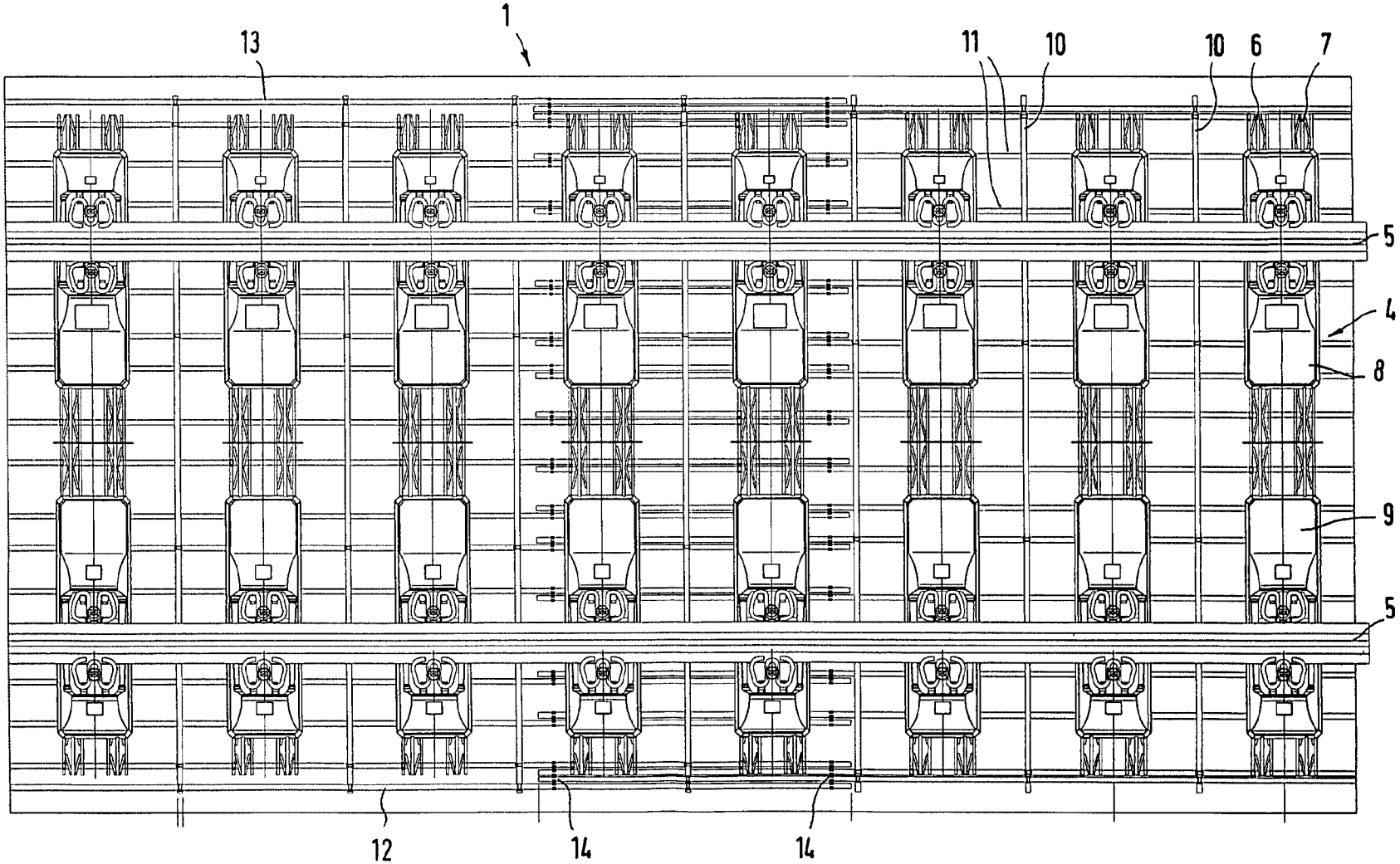
FIG. 1A is a plan view of a fixed carriageway according to the invention in a first embodiment.
Figure 1B:
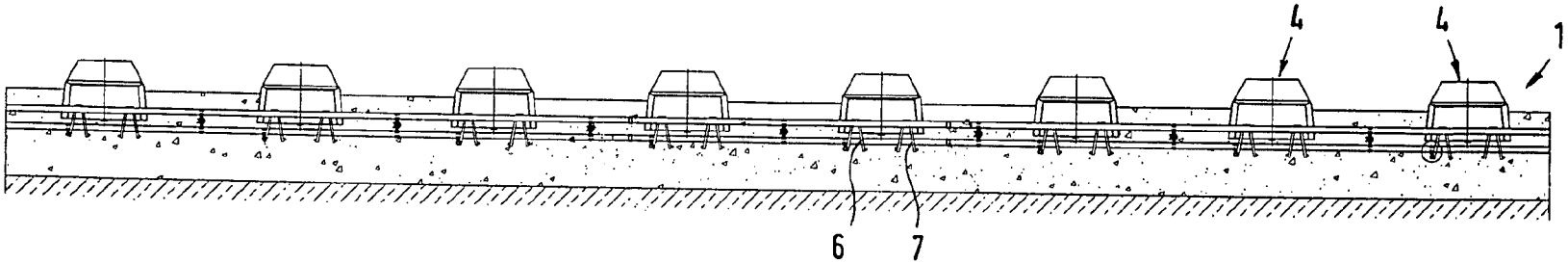
FIG. 1B is a side view of the fixed carriageway shown in FIG. 1A.
Figure 1C:
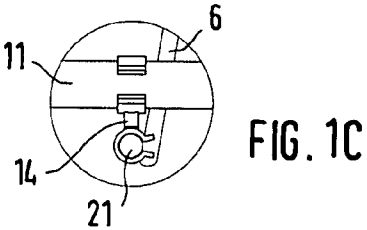
FIG. 1C is an enlarged detail from FIG. 1B.
Figure 1D:
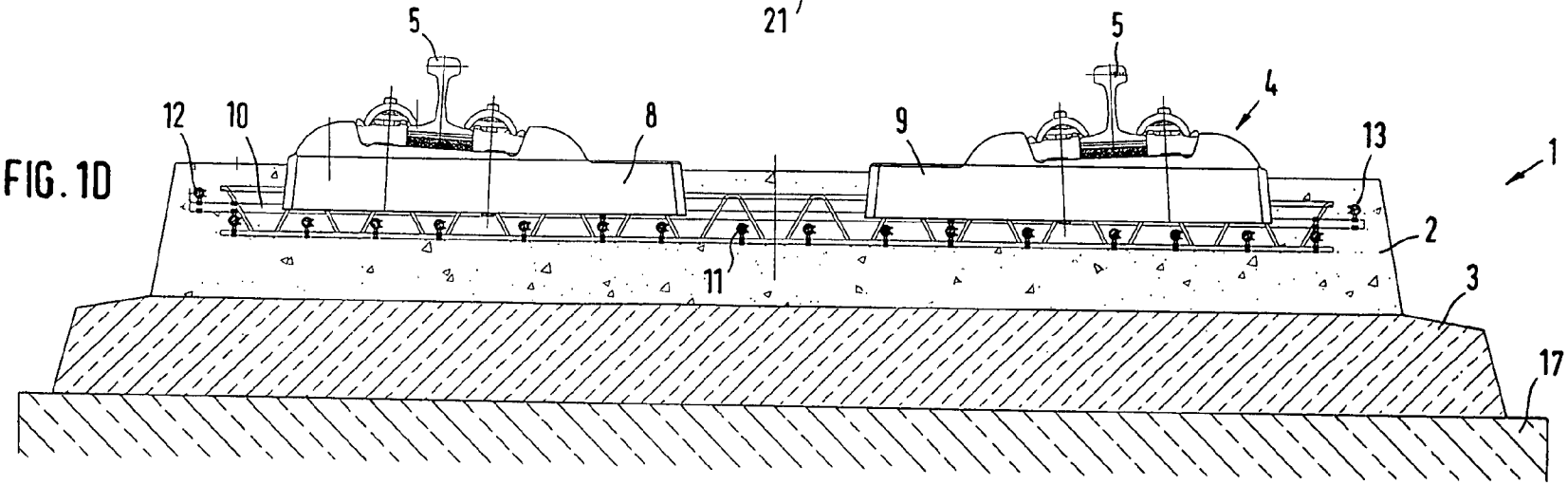
FIG. 1D is a section through the fixed carriageway in the region of a sleeper.

The fixed carriageway 1 shown in FIGS. 1A, 1B and 1D consists essentially of a carriageway panel 2 composed of concrete, which in the embodiment shown rests on a hydraulically bonded support layer as a substructure 3. The substructure 3 rests on a frost-protection layer 17. Sleepers 4, which are formed as dual block sleepers and support the rails 5, are embedded in the carriageway panel 2. Each sleeper 4 comprises two parallel grid supports 6, 7 which are connected to concrete sleeper blocks 8, 9.

As can be best seen from FIG. 1A, between two adjacent sleepers, a respective transverse rod 10 is disposed as part of the reinforcement. In addition, the transversely extending booms of the grid supports 6, 7 act as transverse rods of the reinforcement.

Additionally, the reinforcement comprises longitudinal rods 11 disposed at right angles to the transverse rods and extending parallel to the rails 5. As can be best seen from FIG. 1D, in the embodiment shown, sixteen longitudinal rods 11 are used, which are inserted through the grid supports 6, 7. Additionally, longitudinal rods 12, 13 are disposed at the outer ends of the sleepers 4.

At points of intersection between the transverse rods 10 and longitudinal rods 11 or transverse rods 10 and longitudinal rods 12 or 13, spacers 14 are inserted, which are clipped on to the reinforcement rods having a circular cross-section.

Figure 2A:
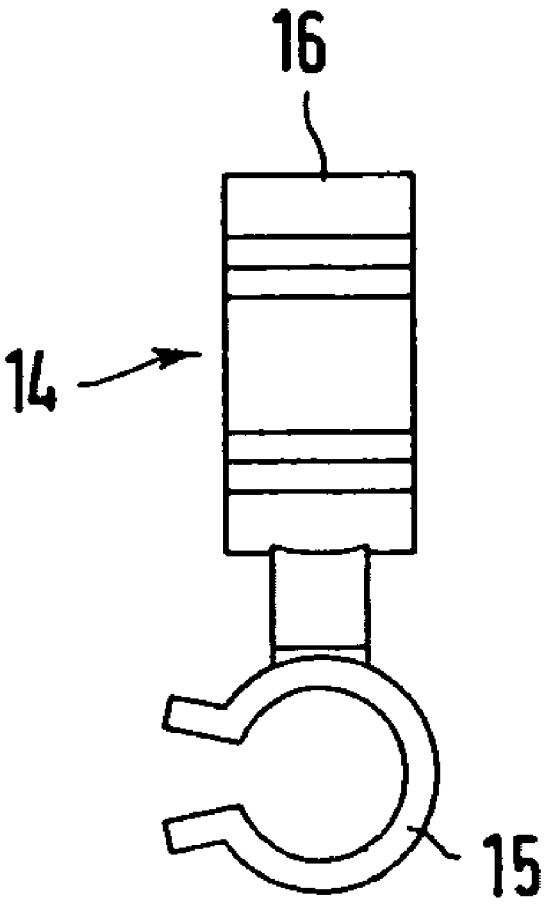
FIG. 2A shows a spacer.
Figure 2B:
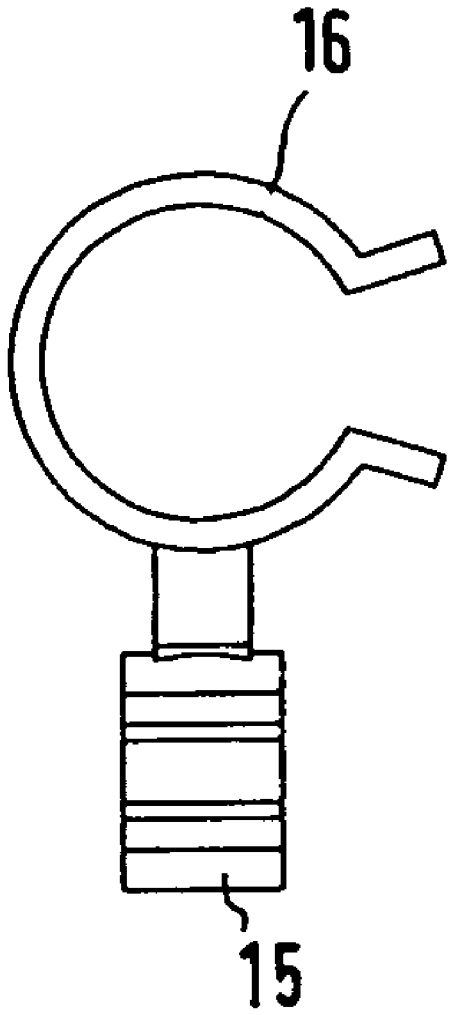
FIG. 2B shows the spacer shown in FIG. 2A in a view rotated through 90°.

FIGS. 2A and 2B show the spacer 14 in two views rotated through 90°. The spacer 14 consists of a first circle-segment-shaped section 15 and a second circle-segment-shaped section 16, which is rotated through 90° with respect to the first circle-segment-shaped section 15. The circle-segment-shaped sections 15, 16 can easily be clipped with their open section on to the reinforcement rods. After mounting of the spacers 14, the two reinforcement rods, e.g. a transverse rod 10 and a longitudinal rod 11, are kept at a fixed distance from one another. The spacers 14 are mounted before casting of the carriageway panel 2 and effect the desired electrical isolation between the longitudinally and transversely extending reinforcement rods. Two different spacers 14 are used. The spacer shown in FIGS. 2A and 2B is for connecting rods of different diameters, possibly for connecting a grid support to a longitudinal rod. In addition, for connecting transverse rods to longitudinal rods, spacers 14 are used in which the circle-segment-shaped sections are the same size.

FIG. 1C shows an enlarged detail from FIG. 1B in the region of the connection of a grid support to a longitudinal rod.

By means of the spacer 14, the longitudinal rod 11 is kept at a specified distance from the transversely extending lower boom 21 of the grid support, and contact and the formation of an electric circuit between the transverse rods 10 and the longitudinal rods 11 is prevented. It is sufficient if the spacers 14 are clipped on to one transverse rod 10 or to one lower boom of a grid support, since thus the other lower booms are electrically isolated from the longitudinal rods.

The two outer longitudinal rods 12, 13 resting on the transverse rods are likewise separated and isolated from the transverse rods 10 by the spacers 14. Two spacers are used per gap between sleepers. The transverse rods in each sleeper gap are likewise isolated by spacers from the longitudinal reinforcement extending below, four spacers being used per transverse rod 10, as can be seen in FIG. 1A.

In addition, the longitudinal rods are also separated from one another in the overlap region by two spacers 14 respectively. The overlap region in the example shown is about 1.2 meters, the individual longitudinal rods 11 being in this case 14 meters long, so that sections having this length are produced which are electrically isolated from one another. The measurements indicated are not to be considered limiting, however, but may be varied depending on the particular requirements.

In FIGS. 3A to 3D, a second embodiment is shown. Where the components correspond to those of the first embodiment, the same references are used.

Corresponding to the first embodiment, the sleepers 4 are embedded in the carriageway panel 2. The reinforcement comprises transverse rods 10 and longitudinal rods 11, which are passed through the grid supports 7, 22.

At some points of intersection between transverse rods 10 and longitudinal rods 11, spacers 14 are clipped on. The same applies to the overlap region of the longitudinal rods 11.

Figure 3A:
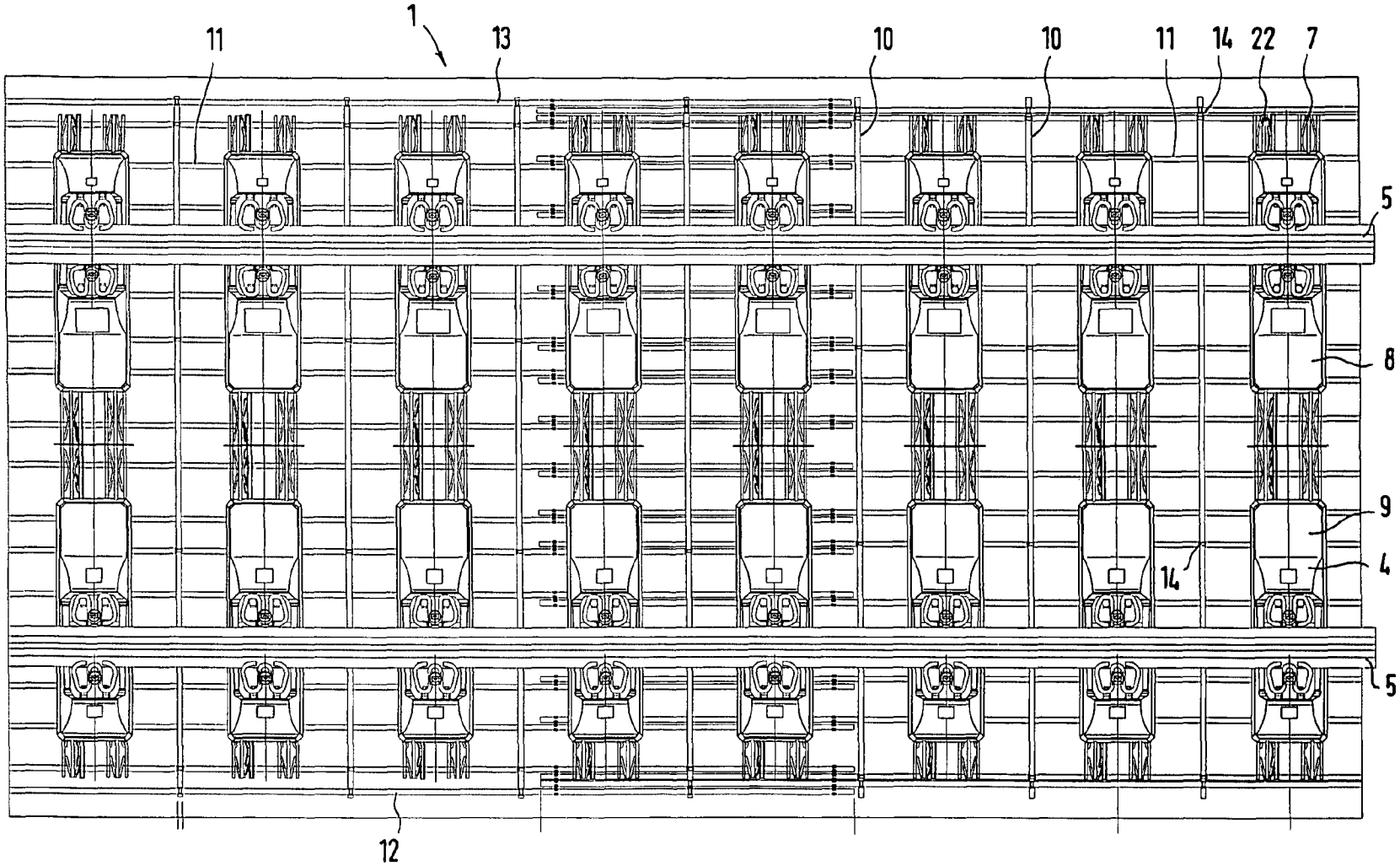
FIG. 3A is a plan view of a fixed carriageway according to the invention in a second embodiment.
Figure 3B:
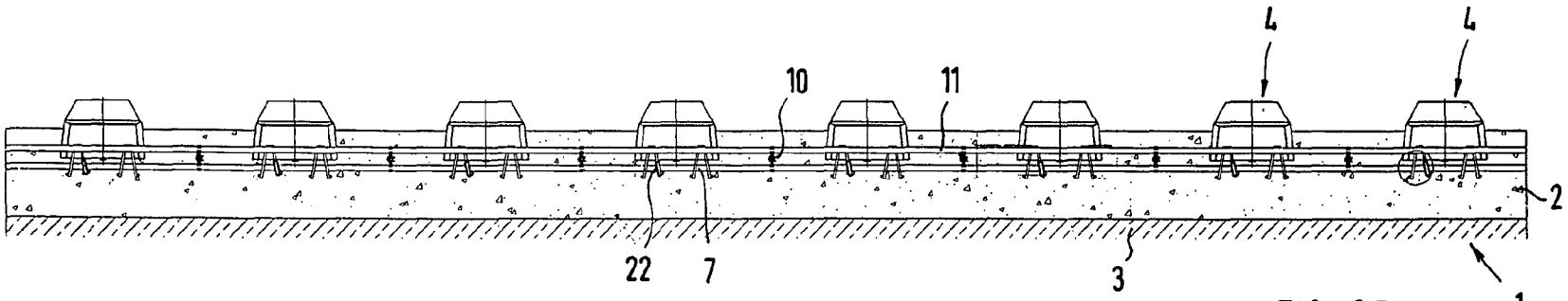
FIG. 3B is a side view of the fixed carriageway shown in FIG. 3A.
Figure 3D:
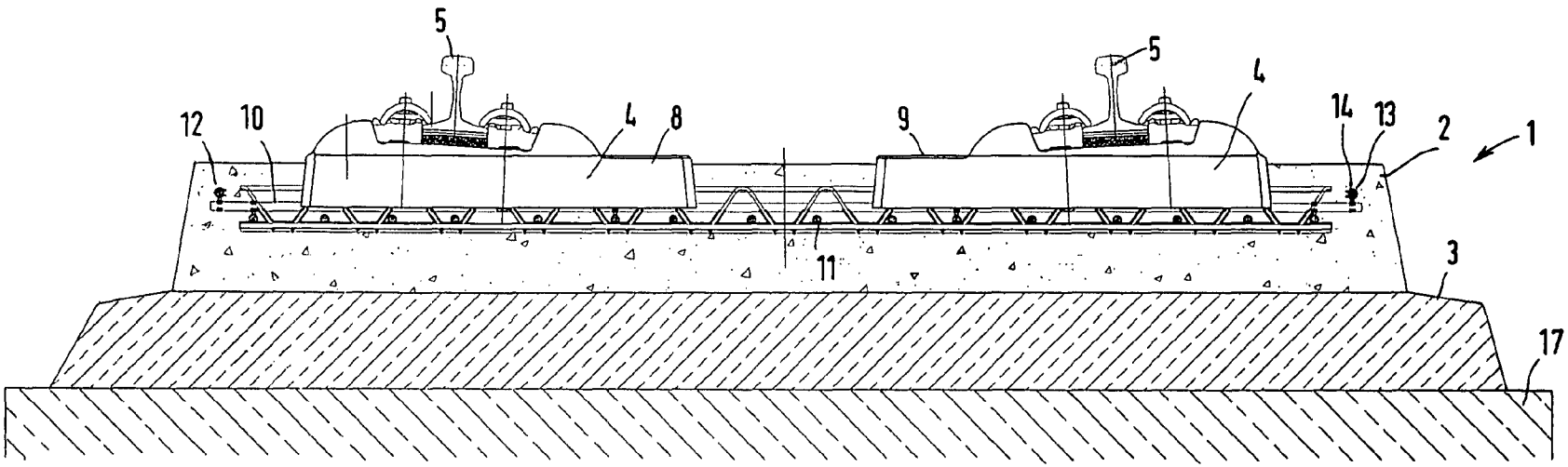
FIG. 3D is a section through the fixed carriageway in the region of a sleeper.
Figure 3C:
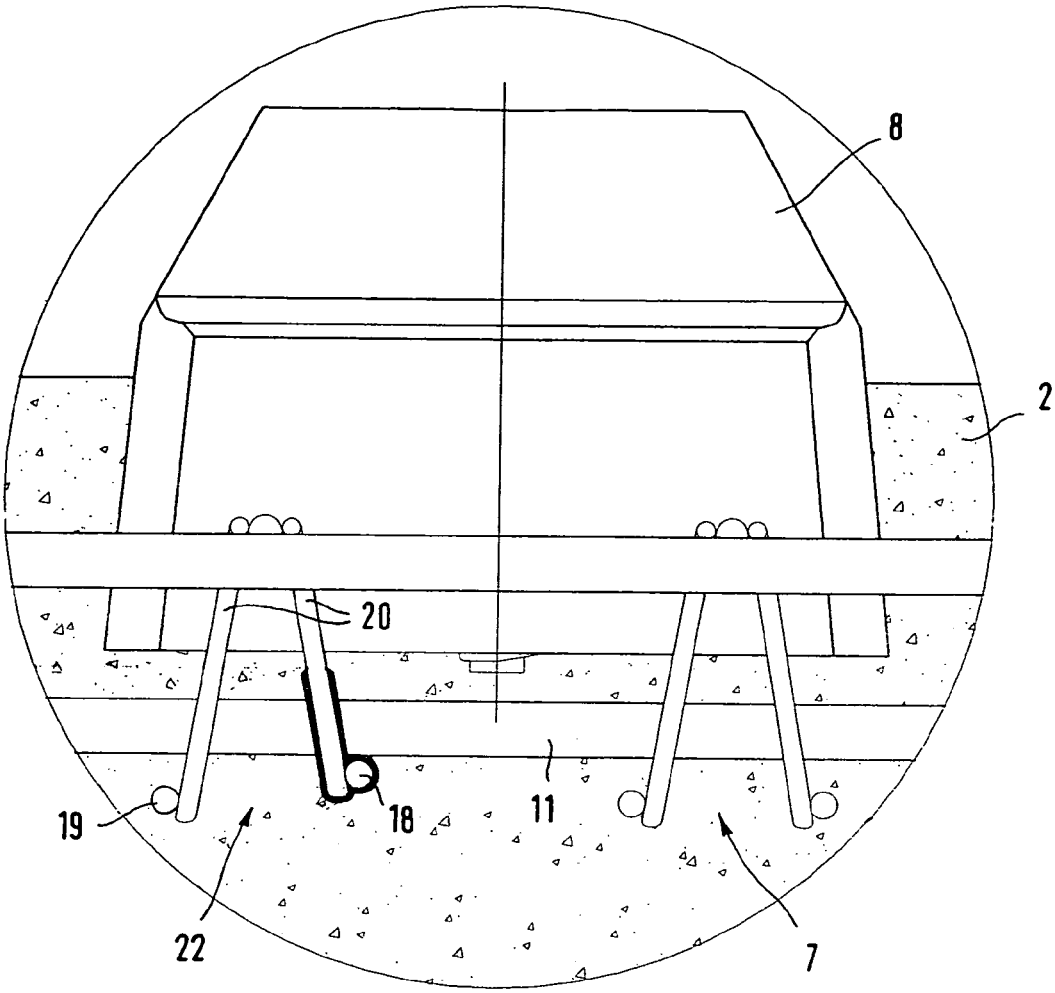
FIG. 3C is an enlarged detail from FIG. 3B.

Unlike in the first embodiment, the grid support 22 of the sleeper has a lower boom 18 with a low height, i.e. this lower boom 18 in the installed state lies higher than the other three lower booms 19 of the sleeper. As can be seen in FIG. 3C, the lower boom 18 has a continuous coating, which extends obliquely upwards along the obliquely extending grid rods 20 of the grid support 22. The coating consists of a plastics material, in this case an epoxy resin. In other embodiments, the coating may consist of a thermoplastic material or another suitable material. As can be seen in FIG. 3C, the longitudinal rod 11 rests on the lower boom 18 and can touch the coated region of the grid rod 20 laterally. By means of the coating, the lower boom 18 and the grid rod 20 connected thereto are electrically isolated from the longitudinal rod 11, and accordingly the formation of short-circuit paths is prevented.

In the embodiment shown, the shortened lower boom 18 of the grid support 22 has a grid support height of 100 mm, whereas the other lower booms are 110 mm high, so that the longitudinal rods 11 only rest on the shortened lower boom 18.

In the method of manufacturing the fixed carriageway, the sleepers are positioned as usual with their grid supports and the transverse rods and longitudinal rods of the reinforcement, and then the spacers are mounted. The other steps in the sequence of the method of construction are not altered, but only the modified grid support 22 is used, which is shown in FIGS. 3A to 3D.

The invention claimed is:

1. A fixed carriageway for rail vehicles, comprising:

sleepers embedded in a carriageway panel; and a reinforcement which comprises longitudinal rods and transverse rods disposed in the carriageway panel parallel and transverse to the sleepers, the longitudinal rods and transverse rods being electrically isolated from one another, at least one transverse rod of the transverse rods having an insulating coating to maintain said at least one transverse rod and said longitudinal rods and remaining ones of said transverse rods isolated from one another, said at least one transverse rod having the insulating coating being formed as a lower boom of a grid support of at least one of the sleepers, said grid support being comprised of lower booms including said at least one lower boom, said longitudinal rods resting only on said at least one lower boom having the insulating coating which is disposed in a position higher that other ones of the lower booms, such that said other ones of the lower booms are maintained in a spaced apart condition from said longitudinal rods.

2. A fixed carriageway according to claim 1, wherein the longitudinal rods and transverse rods are electrically isolated from one another at points of intersection.

3. A fixed carriageway according to claim 1 or 2, wherein overlapping regions of longitudinal rods extending parallel to one another are electrically isolated from one another.

4. A fixed carriageway according to claim 1 wherein:

at least one of the sleepers includes plural grid supports; and only one lower boom of a one of the grid supports has the insulating coating.

5. A fixed carriageway according to claim 1, wherein sections of the grid support adjoining the lower boom have an insulating coating.

6. A fixed carriageway according to claim 1, wherein overlapping regions of longitudinal rods extending parallel to one another and coupled together are electrically isolated from one another.

7. A fixed carriageway according to claim 1, wherein overlapping regions of longitudinal rods are coupled together and are electrically isolated from one another.

8. A fixed carriageway according to claim 1, wherein, in a sleeper having two grid supports with four lower booms, only one lower boom of a grid support has the insulating coating.

9. A method of manufacturing a fixed carriageway for rail vehicles, comprising:

embedding sleepers in a carriageway panel;

providing a reinforcement by disposing plural longitudinal and transverse rods parallel and transverse to the sleepers in the carraigeway panel; and electrically isolating the longitudinal rods and transverse rods from one another by providing at least one rod of the transverse rods with an insulating coating, said at least one rod having the insulating coating being formed as at least one lower boom of a grid support of at least one of the sleepers, said grid support being comprised of lower booms including said at least one lower boom, said longitudinal rods resting only on said at least one lower boom having the insulating coating which is disposed in a position higher than other ones of the lower booms, such that said other ones of the lower booms are maintained in a spaced apart condition from said longitudinal rods.

10. A method according to claim 9, wherein the longitudinal rods and transverse rods are installed electrically isolated from one another at points of intersection.

11. A method according to claim 9 or 10, wherein the longitudinal rods extending parallel to one another are electrically isolated from one another in an overlap region.

12. A method according to claim 9, wherein sections of the grid support adjoining the lower boom are provided with an insulating coating.

13. A method according to claim 9, wherein the longitudinal rods extending parallel to one another and coupled to one another are electrically isolated from one another in an overlap region.

14. A fixed carriageway for rail vehicles, comprising:

sleepers embedded in a carriageway panel;

grid supports connected to each of the sleepers, each of said grid supports including upper booms and lower booms, said lower booms being disposed in positions below said upper booms; and a reinforcement which comprises longitudinal rods and transverse rods disposed in the carriageway panel, said transverse rods including said upper booms and said lower booms, at least one of the lower booms of the grid supports having an insulating coating to maintain said at least one of the lower booms and said longitudinal rods and remaining ones of said transverse rods isolated from one another, said longitudinal rods resting only on said at least one of the lower booms having the insulating coating, with other ones of the lower booms being in a spaced apart condition from said longitudinal rods.

* * * * *